US006386932B1

(12) United States Patent
Murphy

(10) Patent No.: US 6,386,932 B1
(45) Date of Patent: May 14, 2002

(54) INFLATABLE BOAT

(76) Inventor: Michael Murphy, 22981 Sierra Trail, Canyon Lake, CA (US) 92587

( * ) Notice: Subject to any disclaimer, the term of this patent is extended or adjusted under 35 U.S.C. 154(b) by 0 days.

(21) Appl. No.: 09/894,256

(22) Filed: Jun. 27, 2001

Related U.S. Application Data

(60) Provisional application No. 60/214,305, filed on Jun. 27, 2000.

(51) Int. Cl.[7] ..... B63B 1/00
(52) U.S. Cl. ..... 441/66; 114/123; 114/274
(58) Field of Search ..... 441/65, 66, 72, 441/73; 114/123, 274

(56) References Cited

U.S. PATENT DOCUMENTS

| | | | | | |
|---|---|---|---|---|---|
| 3,352,275 | A | * | 11/1967 | Wilson | 114/252 |
| 3,657,753 | A | * | 4/1972 | Le Blanc, Sr. | 441/66 |
| 4,159,689 | A | * | 7/1979 | Odoj | 114/39.14 |
| 5,100,354 | A | * | 3/1992 | Woolley et al. | 441/65 |
| 5,184,564 | A | * | 2/1993 | Robbins et al. | 114/270 |
| 5,544,607 | A | * | 8/1996 | Rorabaugh et al. | 114/123 |
| 5,911,611 | A | * | 6/1999 | Saad | 441/73 |

* cited by examiner

*Primary Examiner*—S. Joseph Morano
*Assistant Examiner*—Ajay Vasudeva
(74) *Attorney, Agent, or Firm*—Joseph E. Mueth

(57) ABSTRACT

An inflatable boat adapted to serve as a training aid and enable a towable personal hydrofoil watersport device adapted to carry a seated rider having an elongate board and a vertical strut extending generally at a right angle to said board to float on the surface of the water comprising:

(a) elongated spaced apart inflatable pontoon sections connected in proximity to their lower extremities by (b) a carrying surface, said pontoon sections and carrying surface forming a generally smooth leading surface for being towed through water with minimum drag, said carrying surface being provided with an opening in proximity to its trailing edge, said opening being adapted to retain said boat and the lateral distance between said pontoon sections being adapted to receive the elongated board of a water sport device adapted to carry a seated rider.

An inflatable boat adapted to serve as a training aid in learning the use of a towable personal hydrofoil watersport device adapted to carry a seated rider, said inflatable boat comprising:

(a) elongated spaced apart inflatable pontoon sections connected in proximity to their lower extremities by (b) a carrying surface including an upper surface, a leading edge and a trailing edge, said pontoon sections and said leading edge of said carrying surface forming a generally smooth leading fairing surface for being towed through water with minimum drag, said carrying surface being provided with an opening in proximity to its trailing edge, said opening being adapted to retain a vertical strut extending downwardly below said carrying surface, said carrying surface further having, in proximity to said opening, means associated therewith to carry a seat on said upper surface.

8 Claims, 4 Drawing Sheets

INFLATABLE BOAT

This patent application claims the filing date of U.S. Provisional Patent Application Ser. No. 60/214,305 filed Jun. 27, 2000.

BACKGROUND OF INVENTION

U.S. Pat. No. 5,100,354, U.S. Pat. No. 5,249,998 and U.S. Pat. No. 6,179,676 disclose a water sport device for supporting a seated human rider while the rider and the device are towed behind a powered water craft. The device includes an elongated board to which a rigidly mounted seat and foot holders are secured. An elongate strut or arm projects downwardly from the board and wings are secured to the arm generally parallel to the board. The positioning of the seat and the wings provide essentially no lift when the board is horizontal. The positioning of the rigidly mounted seat and the wings at the rear of the board, the use of a single vertical strut, the size of the wings and the positioning of the foot holders at least two feet in front of the seat provides a water sports device which is relatively easy to ride, while at the same time being highly maneuverable and capable of high jumps.

These towable personal hydrofoils can be somewhat difficult to learn to ride. Hydrofoil riders often having difficulty bringing the hydrofoil up to the surface of the water from a starting, submerged position when first learning to ride.

The disclosures of U.S. Pat. Nos. 5,100,354, 5,249,998 and 6,179,676 are expressly incorporated herein by reference.

SUMMARY OF INVENTION

This invention comprises an inflatable boat adapted to serve as a training aid and enable a towable, personal hydrofoil watersport device adapted to carry a seated rider having an elongate board and a vertical strut extending generally at a right angle to said board to float on the surface of the water while carrying a rider comprising:

(a) elongated spaced apart inflatable pontoon sections connected in proximity to their lower extremities by (b) a carrying surface including an upper surface, a leading edge and a trailing edge, said pontoons sections and said leading edge of said carrying surface forming a generally smooth leading fairing surface for being towed through water with minimum drag, said carrying surface being provided with an opening in proximity to its trailing edge, said opening being adapted to retain said strut and the lateral distance between said pontoon sections being adapted to receive therebetween the elongated board.

The invention further comprises in combination, a) an inflatable boat comprising (i) elongated spaced apart inflatable pontoon sections connected in proximity to their lower extremities by (ii) a carrying surface including an upper surface, a leading edge and a trailing edge, said pontoon sections and said leading edge of said carrying surface forming a generally smooth leading fairing surface for being towed through water with minimum drag, said carrying surface being provided with an opening in proximity to its trailing edge; and b) a towable personal hydrofoil watersport device adapted to carry a seated rider having an elongate board and a generally vertical strut extending generally at a right angle to said board, wherein said strut is received in said opening and projects downwardly below said carrying surface, and the elongated board rests on the upper surface of said carrying surface between said pontoon sections.

This invention still further comprises an inflatable boat adapted to serve as a training aid in learning the use of a towable personal hydrofoil watersport device adapted to carry a seated rider, said inflatable boat comprising:

(a) elongated spaced apart inflatable pontoon sections connected in proximity to their lower extremities by (b) a carrying surface including an upper surface, a leading edge and a trailing edge, said pontoon sections and said leading edge of said carrying surface forming a generally smooth leading fairing surface for being towed through water with minimum drag, said carrying surface being provided with an opening in proximity to its trailing edge, said opening being adapted to retain a vertical strut extending downwardly below said carrying surface, said carrying surface further having, in proximity to said opening, means associated therewith to carry a seat on said upper surface.

DESCRIPTION OF THE PREFERRED EMBODIMENTS

Figure 1:
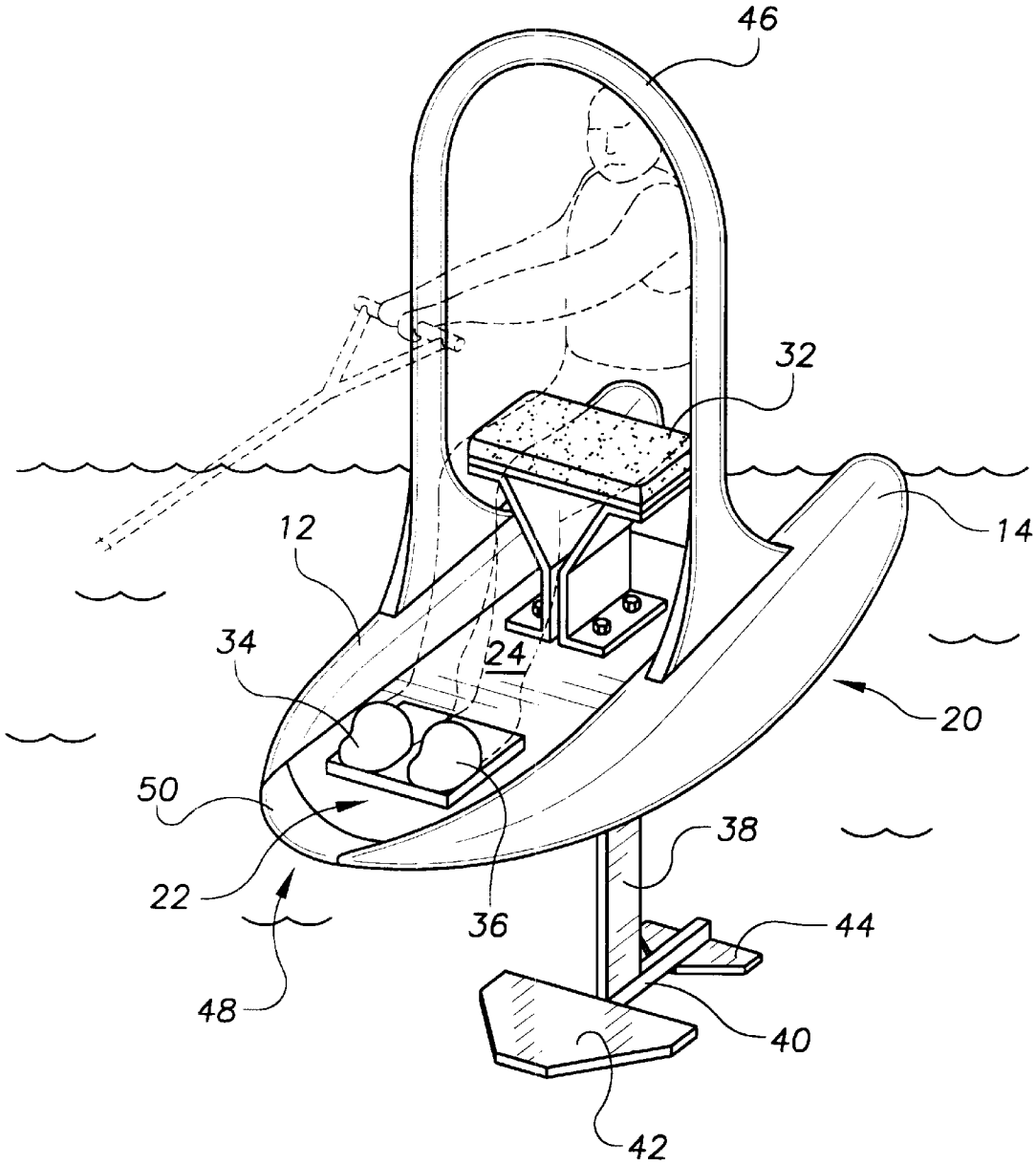
FIG. 1 is a perspective view of the inflatable raft with the hydrofoil watersport device in place thereon.
Figure 2:
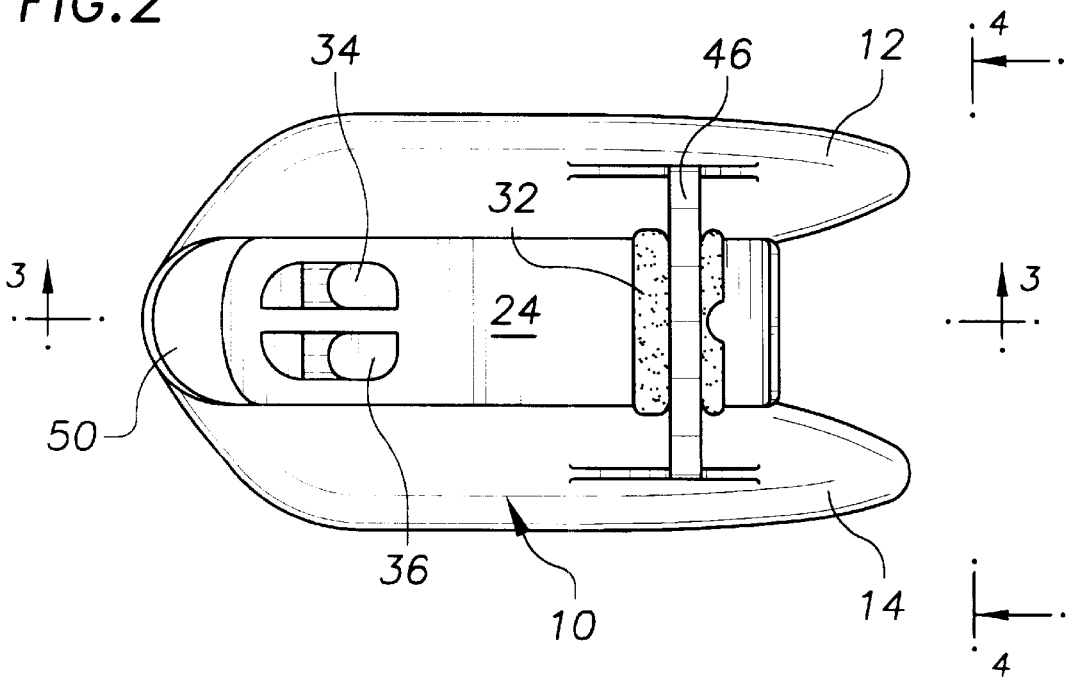
FIG. 2 is a top plan view of the arrangement shown in FIG. 1.
Figure 3:
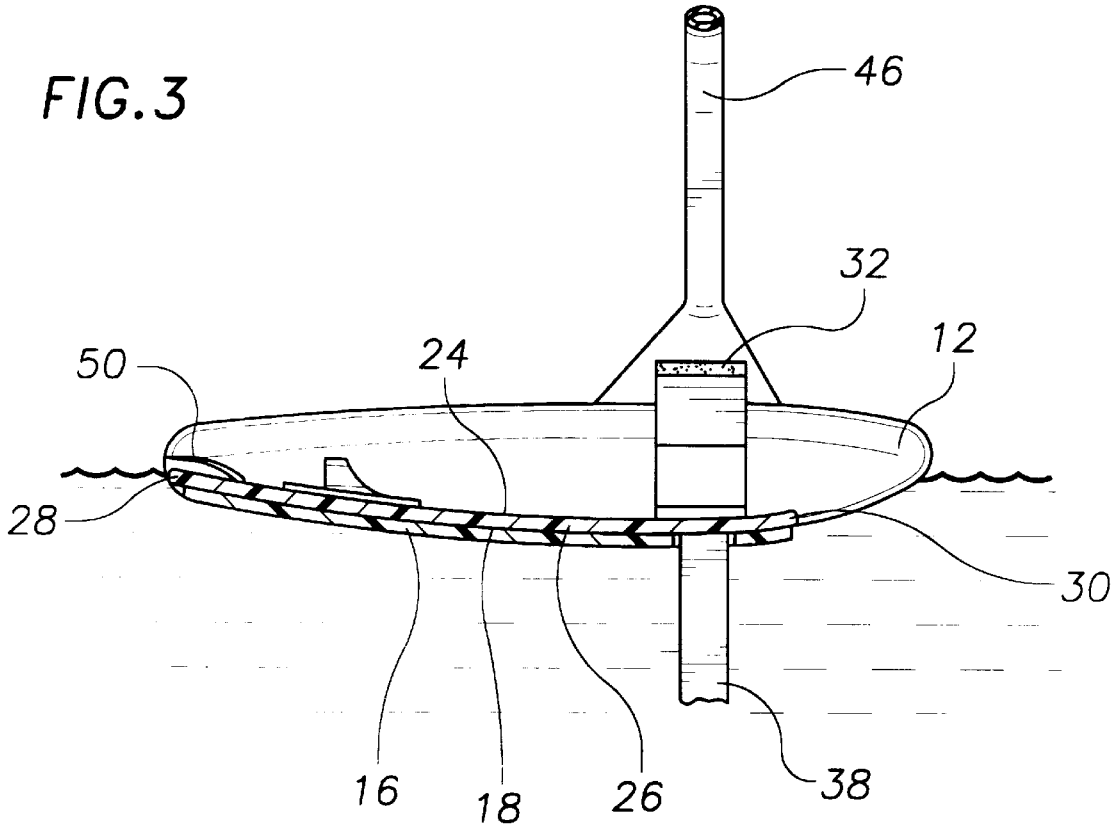
FIG. 3 is a sectional view taken along the line 3—3 in FIG. 2.
Figure 4:
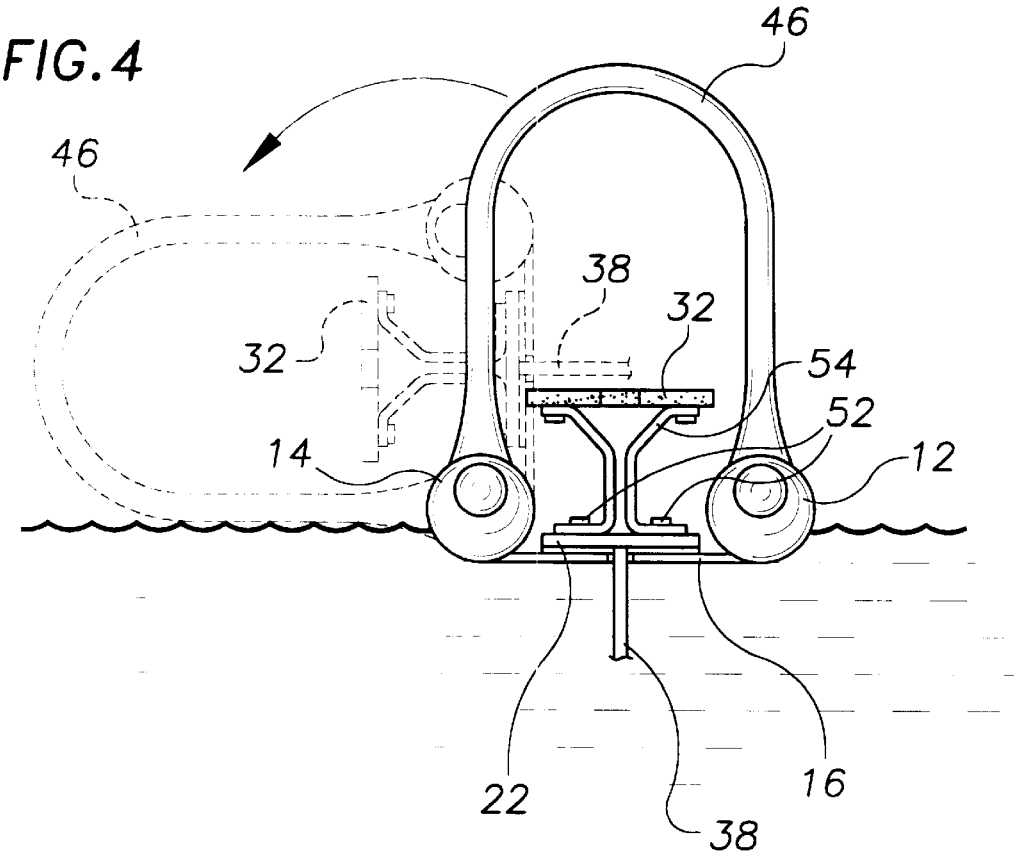
FIG. 4 is a view taken along the line 4—4 in FIG. 3.

Turning to the drawings in greater detail.

Referring to FIGS. 1 to 4, there is shown the use of the inflatable boat of this invention to carry a towable water sports device, normally a "flying ski" or other personal hydrofoil.

The inflatable boat 10 has a pair of elongated spaced apart air inflatable pontoon sections or members 12 and 14. The pontoon members 12 and 14 are connected near their lower extremities by a carrying member 16 which has an upper surface 18. The personal hydrofoil device 20 Includes an elongate board 22 having an upper surface 24 and a lower surface 26, and a front end 28 and a back end 30. A seat 32 extends generally perpendicular to and upward from the upper surface 24 of the board for supporting a seated rider at a point spaced above the board.

The rider's legs extend forward toward the front of the board, where they are secured by a holders 34 and 36, such as a pair of rubber sheets, which are attached to the front end of the board 22 so as to form two semi-circular loops into which the feet of the seated rider are inserted.

An elongate strut 38 extends generally perpendicular to and is secured to the board 22. The strut 38 extending below the board 22 is of a generally water foil shape in cross section. The strut 38 is generally positioned under seat 32.

An elongate fuselage 40 having a forward end and rearward end is fixed to the bottom end of the strut 38 at a point just forward of the middle of the fuselage 40. A forward wing 42 is secured to the top of the forward end of the fuselage 40 so as to be generally parallel to the board 22. Likewise, a rear wing 44 is secured to the bottom of the rearward end of the fuselage 40 generally parallel to the board 22. The planing blade structure (i.e., the strut 38, the fuselage 40, the forward wing 42, the rear wing 44), provides essentially no lift when the board 22 is horizontal.

The combination of the inflatable boat and towable personal hydrofoil device 20 with rider are desirably towed behind a standard powered water craft utilizing a standard ski tow rope, the handle of which is held by the rider (as illustrated in FIG. 1) at a point spaced roughly above the knees of the rider.

Optionally, the inflatable boat preferably has a roll bar 46 connected at its fixed ends to the pontoon members 12 and 14. The roll bar is generally hollow and water tight and, due to its buoyancy, serves, in the event of a spill, to prevent the inflatable raft 10 with the towable personal hydrofoil device 20 carrying a rider from rolling over more than about 90 degrees and specifically to prevent a 180 degree rollover. The rollover bar 46 is normally positioned over the seat 32 to provide maximum benefit to the rider.

The inflatable boat 10 including the forward ends of pontoon sections 12 and 14, has a smooth leading edge or fairing 48 which allows the inflatable raft 10 while carrying the towable personal hydrofoil device 20 to be towed through water with minimum drag. The rear or trailing edge of carrying member 16 is provided with a slot or notch 50 in which the elongate strut 38 is snugly received. The elongated board 22 is snugly received on the upper surface 18 of the carrying member 16 between pontoon sections 12 and 14. The forward edge of elongate board 22 is generally about coterminous with the leading edge or fairing 48 of the inflatable raft 10, and preferably is received in flap 50 which helps to hold the flying ski 20 in place. The flap 50 is generally a taut flexible material joined to the leading edge of the upper surface 18 of the elongate board 22 and the flap opens at its rear edge to provide a tight fitting opening or pocket for the leading edge of board 22.

The pontoon members 12 and 14 are made of rubber or rubberized fabric or any other material suitable for retaining air under pressure. When not in use, the pontoons can be deflated and packed tightly to conserve storage space. The pontoons are provided with valves conventional for the introduction and release of pressurized air. The carrying surface 16 is made of a thin, lightweight, water impervious material which can also be folded for storage.

The optional rollover bar 46 is generally an inflatable hollow, watertight rubberized tubing which is connected to the pontoon sections 12 and 14.

In use, when the inflatable boat 10 and the towable personal hydrofoil device 20 is positioned with the seated rider (shown in dotted lines in FIG. 1), the entire assembly will float on the surface of the water. When towed, the front or leading edge 48 will rise out of the water. In this way, the rider gains confidence and learns the feel of starting out on a towable personal hydrofoil device. Once a process of acclamation to skiing has taken place and the rider has gained confidence, the inflatable raft is no longer needed.

If, during the training process, a spill occurs, the rollover bar 46 prevents the towable personal hydrofoil device from rotating up and over the rider since the bar 46 is effective to limit tipping to about 90 degrees.

The pontoon sections 12 and 14 are shown as being generally separated. It is to be understood that the forward ends of the pontoon members are normally connected, the overall pontoon being roughly "U-shaped".

Figure 5:
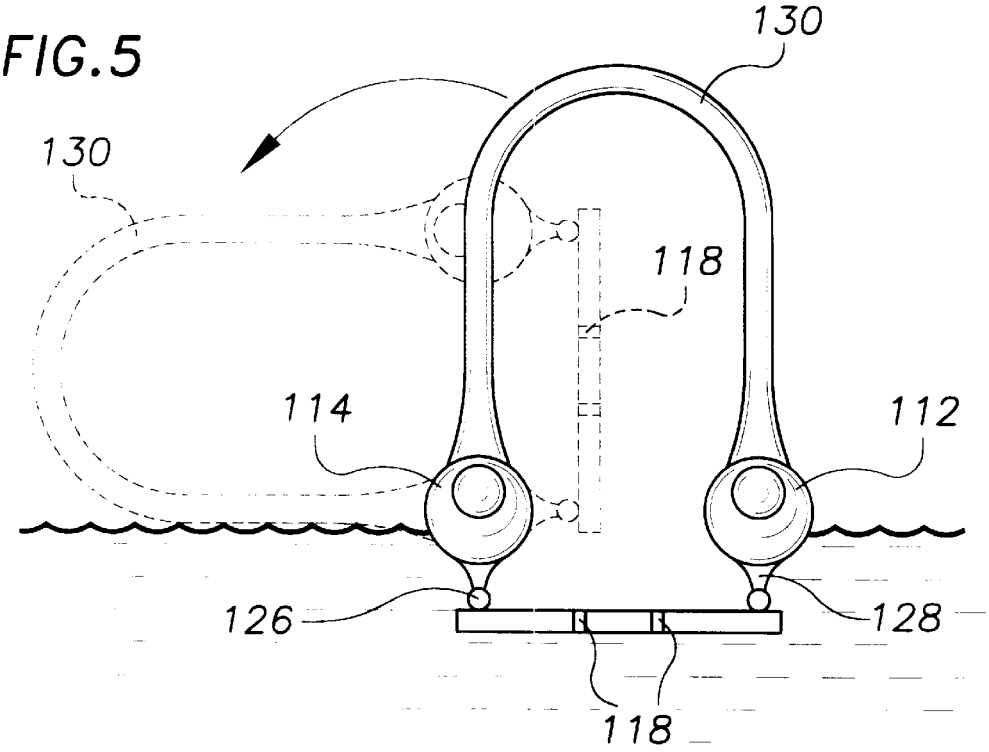
FIG. 5 is a rear view of another embodiment of the invention which provides a training device without using the personal hydrofoil device.
Figure 6:
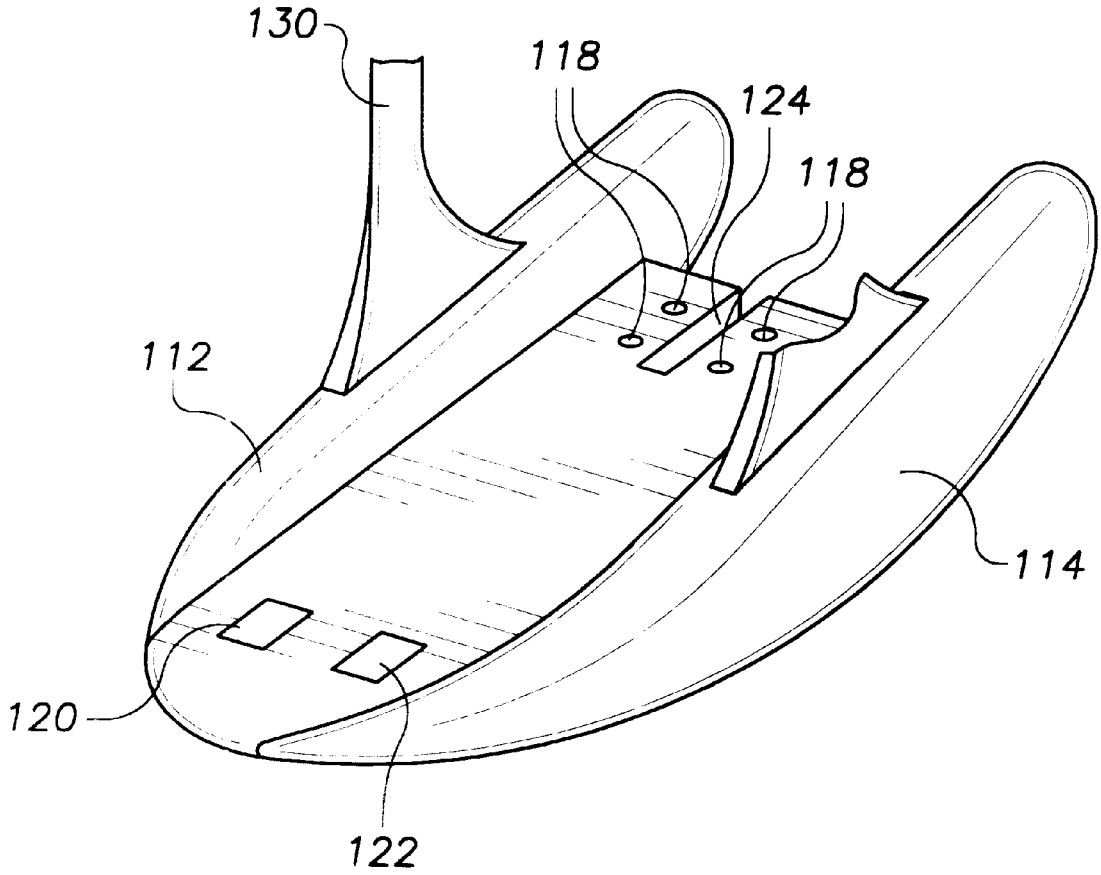
FIG. 6 is a partial perspective view showing the top side of the embodiment of FIG. 5.

FIGS. 5 and 6 show another embodiment of the inflatable boat. In this embodiment, the towable personal hydrofoil device is not used. Instead, the inflatable boat 110 has inflatable pontoon sections 112 and 114 joined by solid, rigid bottom 116. Four holes 118 are provided in bottom 116 to enable the seat 32, shown in the towable personal hydrofoil device of FIGS. 1 to 4, after removal from the towable personal hydrofoil device by unfastening the four bolts 52, to be joined to bottom 116. The seat with its vertical support 54 is attached at holes 118. The bottom 116 has secured thereto foot bindings 120 and 122. The slot 124 is adapted to receive the strut 38, which can also be removed from the hydrofoil device of FIGS. 1 to 4. The slot 124 can be replaced by an opening surrounded by the bottom 116 into which the strut can be received.

The bottom 116 is preferably provided at both of its side margins with elongated upright members 126 slidably received into longitudinal grooves in members 128 running the length of pontoon members 112 and 114 .

This generally tongue and groove like arrangement effectively secures, front to back, the bottom 116 to the pontoon members 112 and 114.

This embodiment has rollover bar 130 which serves as previously discussed. However, in this embodiment, the spacing between pontoon members 112 and 114 is generally wider than the width of board 22 of the towable personal hydrofoil device of FIGS. 1 to 4, thereby making the boat more resistant to rollover. Consequently, it is less hazardous to learn how to ride a towable personal hydrofoil device by using this embodiment of the invention.

What is claimed is:

1. An inflatable boat adapted to serve as a training aid and enable a towable, personal hydrofoil watersport device adapted to carry a seated rider having an elongate board and a generally vertical strut extending generally at a right angle to said board to float on the surface of the water while carrying a rider comprising:

(a) a pair of elongated spaced apart inflatable pontoon sections connected in proximity to their lower extremities by (b) a carrying surface including an upper surface, a leading edge and a trailing edge, said pontoon sections and said leading edge of said carrying surface forming a generally smooth leading fairing surface for being towed through water with minimum drag, said carrying surface being provided with an opening in proximity to its trailing edge, said opening being adapted to retain said strut and the lateral distance between said pontoon sections being adapted to receive therebetween the elongated board while said elongated board is resting on the upper surface of said carrying surface.

2. The inflatable boat of claim 1 having a rollover bar which provides buoyancy in the event of a rollover.

3. The inflatable boat of claim 1 having a flap joined in proximity to said leading edge for receiving a portion of said elongate board.

4. In combination, (a) an inflatable boat comprising (i) a pair of elongated spaced apart inflatable pontoon sections connected in proximity to their lower extremities by (ii) a carrying surface including an upper surface, a leading edge and a trailing edge, said pontoon sections and carrying surface forming a generally smooth leading fairing surface for being towed through water with minimum drag, said carrying surface being provided with an opening extending forwardly from its trailing edge; and (b) a towable personal hydrofoil watersport device adapted to carry a seated rider having an elongate board and a generally vertical strut extending generally at a right angle to said board, wherein said strut is received in said opening and projects downwardly below said carrying surface, and the elongated board rests on the upper surface of said carrying surface between said pontoon sections.

5. The combination of claim 4 wherein the inflatable boat has a rollover bar which provides buoyancy in the event of a rollover.

6. The combination of claim 4 wherein the inflatable boat has a flap in proximity to said leading edge and a portion of said elongate board is received and held in place by said flap.

7. An inflatable boat adapted to serve as a training aid in learning the use of a towable personal hydrofoil watersport device adapted to carry a seated rider, said inflatable boat comprising:

(a) elongated spaced apart inflatable pontoon sections connected in proximity to their lower extremities by (b) a carrying surface including an upper surface, a leading edge and a trailing edge, said pontoon sections and said leading edge of said carrying surface forming a generally smooth leading fairing surface for being towed through water with minimum drag, said carrying surface being provided with an opening in proximity to its trailing edge, said opening being adapted to retain a vertical strut extending downwardly below said carrying surface, said carrying surface further having, in proximity to said opening, means associated therewith to carry a seat on said upper surface.

8. The inflatable boat of claim 7 wherein the inflatable boat has a rollover bar which provides buoyancy in the event of a rollover.

* * * * *